US005152304A

United States Patent [19]

Bokelman et al.

[11] Patent Number: 5,152,304

[45] Date of Patent: Oct. 6, 1992

[54] WRAPPER FOR A SMOKING ARTICLE

[75] Inventors: Gordon H. Bokelman, Chesterfield; Sheryl D. Baldwin, Richmond; Susan S. Tafur, Midlothian; Robert N. Ferguson, Richmond; Barbro L. Goodman, Colonial Heights; Robert M. Rogers, Richmond, all of Va.

[73] Assignee: Philip Morris Incorporated, New York, N.Y.

[21] Appl. No.: 845,741

[22] Filed: Mar. 2, 1992

Related U.S. Application Data

[63] Continuation of Ser. No. 429,317, Oct. 31, 1989, abandoned.

[51] Int. Cl.[5] ..... A24D 1/02

[52] U.S. Cl. ..... 131/365; 131/334; 162/139

[58] Field of Search ..... 131/365, 334; 162/139

[56] References Cited

U.S. PATENT DOCUMENTS

| | | |
|---|---|---|
| 1,996,002 | 3/1935 | Seaman . |
| 2,580,568 | 1/1952 | Matthews et al. . |
| 2,580,609 | 1/1952 | Schur et al. . |
| 2,692,203 | 10/1954 | Klein et al. . |
| 2,754,207 | 7/1956 | Schur et al. . |
| 2,886,042 | 5/1959 | Hoover . |
| 3,385,303 | 5/1968 | Hind et al. . |
| 3,483,874 | 12/1969 | Hind . |
| 3,528,432 | 9/1970 | Stossel . |
| 4,129,134 | 12/1978 | Hind et al. . |
| 4,231,377 | 11/1980 | Cline et al. . |
| 4,453,553 | 6/1984 | Cohn . |
| 4,461,311 | 7/1984 | Mathews et al. . |
| 4,561,454 | 12/1985 | Guess . |
| 4,615,345 | 10/1986 | Durocher . |
| 4,622,983 | 11/1986 | Mathews et al. . |
| 4,679,575 | 7/1987 | Yamaguchi et al. . |
| 4,805,644 | 2/1989 | Hampl, Jr. et al. . |
| 4,836,224 | 6/1989 | Lawson et al. . |

FOREIGN PATENT DOCUMENTS

| | | |
|---|---|---|
| WO 89/08735 | 9/1989 | PCT Int'l Appl. . |
| 2185175A | 7/1987 | United Kingdom . |
| 2191930A | 12/1987 | United Kingdom . |
| 2209269A | 5/1989 | United Kingdom . |

OTHER PUBLICATIONS

William F. Owens, Jr., "Effect of Cigarette Paper On Smoke Yield and Composition", pp. 3-24, vol. 4 of Recent Advances In Tabacco Science, 32nd Tobacco Chemist's Research Conference, Oct. 30-Nov. 1, 1978, Montreal, Canada.

Resnik et al., "Factors Affecting Static Burning Rate," *Tobacco Science* 21:103-107 (1977).

*Primary Examiner*—V. Miller

*Attorney, Agent, or Firm*—Loretta A. Miraglia

[57] ABSTRACT

The sidestream smoke associated with a cigarette or cigarette-like smoking article is reduced by wrapping the tobacco in a paper wrapper having a burn modifier, such as an acidic salt, added thereto. Preferably the paper wrapper has a high basis weight and low porosity.

40 Claims, No Drawings

WRAPPER FOR A SMOKING ARTICLE

This is a continuation of application Ser. No. 429,317, filed Oct. 31, 1989, entitled Wrapper For A Smoking Article, now abandoned.

BACKGROUND OF THE INVENTION

The present invention relates to a wrapper construction for use in conjunction with a smoking article, such as a cigarette, that results in the production of reduced amounts of sidestream smoke. More particularly, this invention relates to a paper wrapper for a cigarette having a particular additive that yields a reduced amount of sidestream smoke.

With marked changes in the public's attitude and tolerance toward cigarette smoking in recent years, there has been an increased hostility by non-smokers toward smokers. This increased hostility occurs primarily in public places where non-smokers may be exposed to the smoke generated from the cigarettes of smokers. This smoke is generated when the smoker puffs on the cigarette and also when the cigarette is idling between puffs. The smoke generated when the cigarette is idling is known as sidestream smoke. This sidestream smoke contributes nothing to the smoker's enjoyment and may contribute greatly to the discomfort of non-smokers who may be located nearby.

Thus attempts have been made to reduce the sidestream smoke generated by cigarettes. These attempts generally have been directed to modifying the cigarette wrapper or the tobacco filler. For example, Mathews et al. U.S. Pat. No. 4,461,311 discloses the use of "extraordinary amounts" of alkali metal salts on the cigarette wrapper for the reduction of sidestream smoke. A level of at least 6% of the salt is needed to achieve the purported benefits described in that patent. The salts disclosed include sodium and potassium salts of numerous organic and inorganic acids. Similarly, Guess U.S. Pat. No. 4,561,454 discloses the use of high levels (9-20%) of alkali metal salts on one wrapper of a dual-wrapped cigarette for sidestream smoke reduction. The salt of choice disclosed in these two patents is potassium citrate. Hampl et al. Great Britain 2,191,930 discloses a cigarette wrapper having high levels (6-12%) of alkali metal salts in combination with a filler of high surface area. This wrapper purportedly reduces sidestream smoke production. Finally, Case et al. Great Britain 2,209,269 discloses the use of high levels of selected burn retardants on the cigarette wrapper in combination with tobacco fillers comprised of at least 20% expanded tobacco to produce cigarettes that generate reduced amounts of sidestream smoke.

The existence of numerous attempts to provide a cigarette that generates a reduced amount of sidestream smoke clearly shows the need in the cigarette industry for such a cigarette. However, none of the prior attempts to provide such a cigarette has been entirely satisfactory and thus none has been successfully developed commercially. The problems with these prior attempts include inadequate sidestream smoke reduction and poor taste characteristics.

It would be desirable to provide a wrapper for a smoking article that results in the production of a reduced amount of sidestream smoke.

It would also be desirable to provide a wrapper for a smoking article that results in the production of a reduced amount of sidestream smoke that does not result in a harsh or unpleasant taste to the smoker.

SUMMARY OF THE INVENTION

It is therefore an object of this invention to provide a wrapper for a smoking article that results in a reduced amount of sidestream smoke.

It is another object of this invention to provide a wrapper for a smoking article that results in the production of a reduced amount of sidestream smoke that does not result in a harsh or unpleasant taste to the smoker.

In accordance with this invention, there is provided a paper wrapper for a smoking article, such as a cigarette, that results in the production of a substantially reduced amount of sidestream smoke. The paper wrapper of this invention has a burn modifier, such as an acidic salt, added thereto and preferably has a high basis weight and a low porosity. When an acidic salt is used, it should be added in an amount such that between about one percent and about four percent by weight of the cation is added to the paper.

A particular example of such a paper wrapper has a basis weight of between about 40 and about 75 grams per square meter, preferably between about 58 and about 63 grams per square meter, and monobasic potassium phosphate added thereto in an amount equal to between about 5 and about 14 percent by weight, preferably about 11 percent by weight. The paper wrapper is loaded with an inorganic filler, such as calcium carbonate having a high surface area, in an amount equal to between about 20 and about 40 percent by weight, preferably about 30 percent by weight. The paper wrapper also has a porosity in the range of between about 2 and about 8 Coresta units, preferably between about 3 and about 6 Coresta units.

DETAILED DESCRIPTION OF THE INVENTION

The cigarette with which the paper wrapper of this invention may be used may be of any length or circumference. For example, the circumference of the cigarette may be in the range from about 15 to about 25 millimeters. The paper wrapper preferably has a high basis weight, i.e. greater than about 40 grams per square meter, and a low porosity to achieve maximum sidestream smoke reduction.

The paper wrappers of this invention may be made from flax or other cellulosic fibers and an inorganic filler, typically calcium carbonate, with a loading of between about 20 percent and about 40 percent by weight, preferably about 30 percent by weight. Other suitable mineral fillers or a combination of fillers may be used. If calcium carbonate is used, the performance of the paper wrapper is enhanced when the surface area of the filler is at least 20 square meters per gram. The paper wrapper should also have a porosity of between about 2 and about 8 Coresta units, preferably between about 3 and about 6 Coresta units. This porosity may be obtained during paper formation or with the use of an additive known to those skilled in the art of papermaking.

The additive for the paper wrapper of this invention is a burn modifier such as an acidic salt. The acidic salts used include acidic salts of inorganic or organic acids including monobasic potassium and sodium salts of polyvalent inorganic acids (such as phosphoric, pyrophosphoric, boric, and sulfuric acids) and mono-potassium and sodium salts of carboxylic acids (such as citric, succinic, and fumaric acids). The pH of an aqueous 0.1 molar solution of the acidic salt should be 5 pH units or less. Preferably monobasic potassium phosphate is used as the acidic salt.

Additionally, compounds which are precursors of acidic species can be used as the additive for the paper wrapper of this invention. Compounds which thermally decompose to generate acidic species in situ can produce the desired sidestream smoke reduction combined with acceptable taste. Salts of polyvalent acids with at least one labile proton may produce the desired effect in the presence of heat and water vapor. Various esters, including phosphate esters (such as the potassium salt of α-D-glucose-1-phosphate), which are acidic precursors, may also be used.

Monobasic potassium phosphate is preferable because of several advantageous characteristics. It has a low melting point to form a stable inorganic liquid. This liquid has been demonstrated by scanning electron microscopy to coat or glaze both the inorganic filler and cellulosic fibers of the paper char. It also dehydrates at 400° C. to form polymeric metaphosphates. Both of these features enhance the ability to form a cohesive ash structure thus promoting sidestream smoke reduction.

Monobasic potassium phosphate also acts as a burn retardant which contributes to sidestream smoke reduction. Finally, monobasic potassium phosphate increases the surface area of the paper char which may increase the effectiveness of the char for sidestream reduction by increasing the sites available for reburn or possible cracking of condensable volatiles to lighter gases.

It has been found that the addition of acidic salts results in a reduction in sidestream smoke and helps control the burn rate of the paper wrapper. In addition, acidic salts provide cigarettes that have an acceptable taste to smokers.

The acidic nature of the additive is important because this enhances the taste of the smoking article made with paper wrappers of this invention. The acidic character of the additive is maintained when the additive is added to the paper as shown by pH measurements of paper wrappers and their respective ashes. For example, the pH of a paper wrapper to which monobasic potassium phosphate has been added is two and one-half pH units less than the pH of a paper wrapper to which tribasic potassium phosphate has been added at equivalent potassium levels.

Although not wishing to be bound by theory, it is believed that the improved taste resulting from the use of an acidic salt is based on the known effect of acidic versus alkaline additives on cellulose pyrolysis. Basic additives cause fragmentation of cellulose into more lower weight compounds including those often considered detrimental to taste. Acidic salts lead to less fragmentation with the production of more levoglucosenone which is distillable and anhydrosugars and furans, all of which would be expected to have no adverse effect on taste.

The acidic salt should be added in an amount such that the amount of the cation added is equal to between about one and about four percent by weight. The preferred range for the cation depends on which acidic salt is used. Where potassium is the cation, preferably the acidic salt should be added in an amount such that between about 2.2 and about 4.0 percent by weight of potassium is added. Where sodium is the cation, preferably the acidic salt should be added in an amount such that between about 1.2 and about 2.5 percent by weight of sodium is added.

Combinations of acidic salts, such as monobasic potassium phosphate combined with monobasic potassium citrate, monobasic sodium phosphate, or other salts which will decrease sidestream smoke production in cigarettes may be used as the additive for the paper wrapper of this invention. In addition, combinations of other salts can be used when an aqueous solution of the mixture of salts has a final pH of 5 or less.

Combinations of salts, at least one of which is acidic or is a precursor of acidic species, can be used to reduce sidestream smoke and to produce an acceptable tasting cigarette. This effect may result, in part, from control of the static burn time of the paper wrapper. For example, monobasic potassium phosphate added to a paper wrapper produces a longer static burn time than monobasic potassium citrate. On a very high basis weight paper of about 63 square grams per meter, which ordinarily burns rapidly, the use of monobasic potassium phosphate alone acts as a burn retardant to produce a cigarette product with a normal puff count. On a 40 gram per square meter paper wrapper, the combination of monobasic potassium citrate with monopotassium phosphate as the paper additive can provide optimal burn time. The amounts of acidic salts to be combined depend on the basis weight and porosity of the paper wrapper and can be determined by simple routine experimentation.

A particular example of the paper wrapper of this invention has a basis weight of between about 40 and about 75 grams per square meter. Preferably the basis weight is between about 58 and about 63 grams per square meter. Monobasic potassium phosphate is added to the paper wrapper in an amount equal to between about 5 and about 14 percent by weight, preferably about 11 percent by weight. An inorganic filler, preferably calcium carbonate having a surface area of at least 20 square meters per gram, is used in an amount equal to between about 20 percent and about 40 percent by weight, preferably about 30 percent by weight. The paper wrapper also has a porosity in the range of between about 2 and about 8 Coresta units, preferably between about 3 and about 6 Coresta units.

The following examples illustrate the beneficial results of this invention. To measure the amount of sidestream smoke generated, burning cigarettes are allowed to idle while the sidestream smoke travels through a cell through which a light is passed. A photocell detects the transmitted light intensity during the burning of 30 millimeters of the tobacco rod. The measured light intensity is averaged over the course of the burning and compared to the light intensity when no smoke is present in the cell. The value is reported as the extinction coefficient. The tables in the following examples show the percent reduction in visible sidestream smoke as calculated from the extinction coefficients of the test samples versus a control. The control is either a typical 85 or 100 millimeter commercial cigarette having a 25 gram per square meter paper wrapper with a porosity of about 30 Coresta units and a citrate additive. Test cigarettes were made either by hand or on a commercial cigarette maker at comparable packing density using the same tobacco filler as the control. All test samples were of standard circumference (about 25 millimeters) and 85 or 100 millimeters in length with a 27 millimeter cellulose acetate filter.

EXAMPLE 1

All of the paper wrappers in Example 1 were made from paper handsheets having 30% calcium carbonate filler with a surface area of 22 square meters per gram. They have a basis weight of 63 grams per square meter and a porosity of 2.2–2.3 Coresta units. Handmade cigarettes were prepared from the paper wrappers using a typical commercial blended filler packed at 690 milligrams per 57 millimeters of tobacco rod length. Table 1 shows the effect of the addition of increasing levels of monobasic potassium phosphate ($KH_2PO_4$). on sidestream visibility.

TABLE 1

EFFECT OF MONOBASIC POTASSIUM PHOSPHATE ON REDUCTION OF VISIBLE SIDESTREAM SMOKE

| PRODUCT | % $KH_2PO_4$ ON PAPER | EXTINCTION COEFFICIENT | % SIDE-STREAM REDUCTION |
|---|---|---|---|
| Test Sample 1 | 4.0 | 0.46 | 27 |
| Test Sample 2 | 8.5 | 0.35 | 44 |
| Test Sample 3 | 12.3 | 0.18 | 71 |
| Control | — | 0.63 | — |

This example clearly shows the effectiveness of monobasic potassium phosphate as a paper additive for the reduction of visible sidestream smoke. The effect is enhanced in these test samples by the high basis weight of the paper and its low porosity.

EXAMPLE 2

The paper wrappers described in Example 2 have 35% calcium carbonate filler with a surface area of 22 square meters per gram, a basis weight of 42.6 grams per square meter, and a porosity of 5 Coresta units. Handmade cigarettes were prepared from samples of paper to which monobasic potassium phosphate or a mixture of monobasic and dibasic potassium phosphate were added at comparable potassium levels. A comparison was made of the effect of the pH of the additives on the paper wrappers.

TABLE 2

EFFECT OF pH OF PAPER ADDITIVES

| PRODUCT | WRAPPER ADDITIVE | pH OF ADDITIVE SOLUTION | % SIDE-STREAM REDUCTION |
|---|---|---|---|
| Test Sample 4 | 12.5% $KH_2PO_4$ | 4 | 32 |
| Test Sample 5 | 1.7% $K_2HPO_4$<br>9.9% $KH_2PO_4$ | 6 | 13 |

This example shows the beneficial results of using a more acidic salt such as monobasic potassium phosphate rather than the mixed salts at pH 6. Not only is the more acidic additive more effective for reducing visible sidestream, but Test Sample 4 was also subjectively preferable to Test Sample 5.

A comparison of the results in Example 2 with those cited in Example 1 emphasizes the enhanced effectiveness of low porosity, high basis weight wrappers.

EXAMPLE 3

All of the cigarette test samples in Example 3 have paper wrappers with 35% calcium carbonate filler with a surface area of 22 square meters per gram, a basis weight of 45 grams per square meter and a porosity of 5 Coresta units. Machine-made cigarettes were prepared from paper wrappers which had different potassium phosphate salts added to the papers as shown in Table 3. The differences in additive levels were made to provide comparable (approximately 3%) potassium levels on each paper.

TABLE 3

COMPARISON OF DIFFERENT POTASSIUM PHOSPHATE SALTS

| PRODUCT | WRAPPER ADDITIVE | % SIDE-STREAM REDUCTION | STATIC BURN (min/40 mm rod) |
|---|---|---|---|
| Test Sample 6 | 9.8% $KH_2PO_4$ | 53 | 7.3 |
| Test Sample 7 | 7.3% $K_2HPO_4$ | 44 | 6.0 |
| Test Sample 8 | 5.4% $K_3PO_4$ | 37 | 5.8 |

This example shows the superiority of monobasic potassium phosphate ($KH_2PO_4$). over its di- and tripotassium forms which are more alkaline. It also demonstrates the important feature of a longer static burn time for papers with monobasic potassium phosphate. When used on high basis weight papers to have maximum effectiveness, there is a need for the burn retardant effect to give cigarette products with normal puff counts.

The observation of the superiority of acidic forms of selected salts for the reduction of sidestream smoke represents a clear departure from past teachings. The prior art does not differentiate among mono-, di-, or tribasic salts of inorganic or organic acids. Acidic salts are considered unique because they act by a mechanism different from those proposed previously for sidestream smoke reduction. The importance of this difference has not been recognized by those skilled in the art of developing cigarettes which produce reduced amounts of sidestream smoke. In addition, the acidic character of the salts also results in a cigarette that is clearly preferable in terms of taste over cigarettes having wrappers with more alkaline salts added thereto. The combination of acidic salts or acidic precursors with high basis weight papers allows the development of substantially reduced sidestream cigarette products acceptable to smokers.

Thus it is seen that a paper wrapper for a cigarette is provided that results in reduced amounts of sidestream smoke but does not result in a harsh or unpleasant taste to the smoker. One skilled in the art will appreciate that the present invention can be practiced by other than the described embodiments, which are presented for purposes of illustration and not of limitation, and the present invention is limited only by the claims that follow.

What is claimed is:

1. A paper wrapper for a smoking article having a basis weight of between about 40 and about 75 grams per square meter, a filler loading of between about 20 and about 40 percent by weight, a porosity of between about 2 and 8 Coresta units, and between about 5 and about 14 percent by weight of a burn modifier.

2. The paper wrapper of claim 1 wherein said burn modifier is an acidic salt.

3. The paper wrapper of claim 2 wherein said acidic salt gives a pH of 5 or less for an aqueous 0.1 molar solution.

4. The paper wrapper of claim 2 wherein said acidic salt is a combination of two or more salts which gives a pH of 5 or less for an aqueous 0.1 molar solution.

5. The paper wrapper of claim 3 wherein said acidic salt is selected from the group consisting of monobasic potassium salts of polyvalent inorganic acids and carboxylic acids.

6. The paper wrapper of claim 5 wherein the cation of said acidic salt comprises between about 2.2 and about 4.0 percent by weight of said paper wrapper.

7. The paper wrapper of claim 3 wherein said acidic salt is selected from the group consisting of monobasic sodium salts of polyvalent inorganic acids and carboxylic acids.

8. The paper wrapper of claim 7 wherein the cation of said acidic salt comprises between about 1.2 and about 2.5 percent by weight of said paper wrapper.

9. The paper wrapper of claim 2 wherein said acidic salt is monobasic potassium phosphate.

10. The paper wrapper of claim 1 wherein said burn modifier is an acid precursor which decomposes thermally to generate acidic species in situ as said smoking article is smoked.

11. The paper wrapper of claim 1 wherein said burn modifier is the salt of a polyvalent acid with at least one labile proton.

12. The paper wrapper of claim 1 wherein said burn modifier is a combination of two or more additives at least one of which is acidic or a precursor of acidic species.

13. A paper wrapper for a smoking article comprising a cellulosic base web, a filler loading and an acidic salt of a polyvalent acid with at lest one labile proton.

14. The paper wrapper of claim 13 wherein said acidic salt is selected from the group consisting of monobasic potassium salts of polyvalent inorganic acids and carboxylic acids.

15. The paper wrapper of claim 13 wherein said acidic salt is monobasic potassium phosphate.

16. The paper wrapper of claim 13 wherein said acidic salt gives a pH of 5 or less for an aqueous 0.1 molar solution.

17. The paper wrapper of claim 13 wherein said acidic salt is a combination of two or more salts which gives a pH of 5 or less for an aqueous 0.1 molar solution.

18. The paper wrapper of claim 14 wherein the cation of said acidic salt comprises between about 2.2 and about 4.0 percent by weight of said paper wrapper.

19. The paper wrapper of claim 13 wherein said acidic salt is selected from the group consisting of monobasic sodium salts of polyvalent inorganic acids and carboxylic acids.

20. The paper wrapper of claim 19 wherein the cation of said acidic salt comprises between about 1.2 and about 2.5 percent by weight of said paper wrapper.

21. A paper wrapper for a smoking article comprising a cellulosic base web, a filler loading and one or more salts, at least one of which is acidic or is an acid precursor which decomposes thermally to generate acidic species in situ as said smoking article is smoked.

22. A paper wrapper of claim 5 wherein said inorganic acids are selected from the group consisting of phosphoric, pyrophosphoric, boric, and sulfuric acids.

23. A paper wrapper of claim 5 wherein said carboxylic acids are selected from the group consisting of citric, succinic, and fumaric acids.

24. A paper wrapper of claim 7 wherein said inorganic acids are selected from the group consisting of phosphoric, pyrophosphoric, boric, and sulfuric acids.

25. A paper wrapper of claim 7 wherein said carboxylic acids are selected from the group consisting of citric, succinic, and fumaric acids.

26. A paper wrapper of claim 14 wherein said inorganic acids are selected from the group consisting of phosphoric, pyrophosphoric, boric, and sulfuric acids.

27. A paper wrapper of claim 14 wherein said inorganic acids are selected from the group consisting of phosphoric, pyrophosphoric, boric, and sulfuric acids.

28. A paper wrapper of claim 19 wherein said inorganic acids are selected from the group consisting of phosphoric, pyrophosphoric, boric, and sulfuric acids.

29. A paper wrapper of claim 19 wherein said carboxylic acids are selected from the group consisting of citric, succinic, and fumaric acids.

30. A paper wrapper for a smoking article having a basis weight of between about 40 grams per square meter and about 75 grams per square meter, a filler loading of between about 20 percent by weight and about 40 percent by weight and between about 5 percent by weight and about 14 percent by weight of an acidic salt.

31. A paper wrapper for a smoking article having a filler loading of between about 20 percent by weight and about 40 percent by weight, an inherent porosity of between about 2 Coresta units and about 8 Coresta units and between about 5 percent by weight and about 14 percent by weight of an acidic salt.

32. A smoking article comprising a tobacco filler surrounded by a paper wrapper having a cellulosic base web, a filler loading and an acidic salt of a polyvalent acid with at least one labile proton.

33. A smoking article comprising a tobacco filler surrounded by a paper wrapper having a basis weight of between about 40 grams per square meter and about 75 grams per square meter, a filler loading of between about 20 percent by weight and about 40 percent by weight, an inherent porosity of between about 2 Coresta units and about 8 Coresta units and between about 5 percent by weight and about 14 percent by weight of a burn modifier.

34. The smoking article of claim 33 wherein said burn modifier is an acidic salt.

35. The smoking article of claim 34 wherein said acidic salt is a combination of two or more salts.

36. The smoking article of claim 33 wherein said burn modifier is an acid precursor which decomposes thermally to generate acidic species in situ as said smoking article is smoked.

37. The smoking article of claim 33 wherein said burn modifier is a combination of two or more additives at least one of which is acidic or a precursor or acidic species.

38. The smoking article comprising a tobacco filler surrounded by a paper wrapper having a basis weight of between about 40 grams per square meter and about 75 grams per square meter, a filler loading of between about 20 percent by weight and about 40 percent by weight and between about 5 percent by weight and about 14 percent by weight of an acidic salt.

39. A smoking article comprising a tobacco filler surrounded by a paper wrapper having a filler loading of between about 20 percent by weight and about 40 percent by weight, an inherent porosity of between about 2 Coresta units and about 8 Coresta units and between about 5 percent by weight and about 14 percent by weight of an acidic salt.

40. A smoking article comprising a tobacco filler surrounded by a paper wrapper having a cellulosic base web, a filler loading and one or more salts added thereto, at least one of which is acidic or is an acid precursor which decomposes thermally to generate acidic species in situ as said smoking article is smoked.

* * * * *